US007946888B2

(12) United States Patent
Wu et al.

(10) Patent No.: US 7,946,888 B2
(45) Date of Patent: May 24, 2011

(54) ELECTRICAL CONNECTOR WITH IMPROVED CONTACTS

(75) Inventors: Chun-Kwan Wu, Tu-Cheng (TW); Chih-Hsiang Ho, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/570,146

(22) Filed: Sep. 30, 2009

(65) Prior Publication Data

US 2010/0081330 A1 Apr. 1, 2010

(51) Int. Cl.
*H01R 24/00* (2011.01)

(52) U.S. Cl. ..... 439/626

(58) Field of Classification Search ..... 439/626, 439/570, 357–358, 492–499
See application file for complete search history.

(56) References Cited

U.S. PATENT DOCUMENTS 5,616,050 A * 4/1997 Suski ..... 439/495
6,986,670 B2 * 1/2006 Okura et al. ..... 439/74
7,112,091 B2 * 9/2006 Okura et al. ..... 439/570
7,278,861 B2 10/2007 Kishi et al.

* cited by examiner

*Primary Examiner* — Jean F Duverne
(74) *Attorney, Agent, or Firm* — Ming Chieh Chang; Wei Te Chung; Andrew C. Cheng

(57) ABSTRACT

An electrical connector mating with a counterpart connector includes: an insulating housing having sidewalls and end-walls to define a receiving room and a number of contacts retained in the insulating housing. The contact has a first mating portion retained on an outer surface of the sidewall and a second mating portion retained on an inner surface of the sidewall to face the receiving room. The first mating portion and the second mating portion define a U-shaped structure riding on the sidewall. A gap is defined between said first mating portion and the sidewall so that the first mating portion can flexible move in the gap to absorb a dimensional tolerance during the mating process and get a stable connection with the counterpart connector.

16 Claims, 8 Drawing Sheets

ELECTRICAL CONNECTOR WITH IMPROVED CONTACTS

BACKGROUND OF THE INVENTION

1. Field of the Invention

The present invention relates to an electrical connector with a stable connection with a counterpart connector.

2. Description of Related Art

An electrical connector assembly is used for connecting with two PCBs. As disclosed in U.S. Pat. No. 7,278,861, an electrical connector assembly includes a receptacle and a plug mating with the receptacle. Said receptacle includes a first insulating housing defining a receiving room and a plurality of first contacts retained in the first insulating housing. Said first insulating housing has four peripheral sidewalls surrounding the receiving room and a tongue portion surrounded by said sidewalls and extending upwardly into the receiving room. The first contact includes a first mating portion retained on an inner surface of the sidewall and a second mating portion retained on one side of the tongue portion opposite to said first mating portion. The plug includes a second insulating housing and a plurality second contacts mating with said first contacts. Said second contact has a first contacting arm retained on an outer surface of the sidewall for mating with the first mating portion and a second contacting arm retained on an inner surface of the sidewall for mating with the second mating portion and defining a U-shaped structure with said first mating portion. Said first contacting arm has a rigid tip end abutting against the sidewall without flexibility. During the receptacle mates with the plug, if the first contacts of the receptacle mate with the second contacts of the plug along a direction offset to a premeditated mating direction, a dimensional tolerance will be generated between said first contacts and second contacts. Said rigid first contacting arm is retained in the sidewall and fails to provide a flexible mating force during the mating process. As a result, the rigid first contacting arm can not absorb said dimensional tolerance and adjust the mating process to get a stable connection between the first contacts and the second contacts.

So it is necessary to provide a new electrical connector to solve the problems above.

SUMMARY OF THE INVENTION

Accordingly, it is an object of the present invention to provide an electrical connector which can provide a stable connection with a counterpart connector.

In order to achieve above-mentioned object, an electrical connector is provided and comprises: an insulating housing having sidewalls and endwalls to define a receiving room; a plurality of contacts retained in the insulating housing, said contact having a first mating portion retained on an outer surface of the sidewall and a second mating portion retained on an inner surface of the sidewall to face the receiving room. Said first mating portion and said second mating portion define a U-shaped structure riding on the sidewall. A gap is defined between said first mating portion and the sidewall.

Other objects, advantages and novel features of the present invention will become more apparent from the following detailed description of the present embodiment when taken in conjunction with the accompanying drawings.

DETAILED DESCRIPTION OF THE INVENTION

Figure 1:
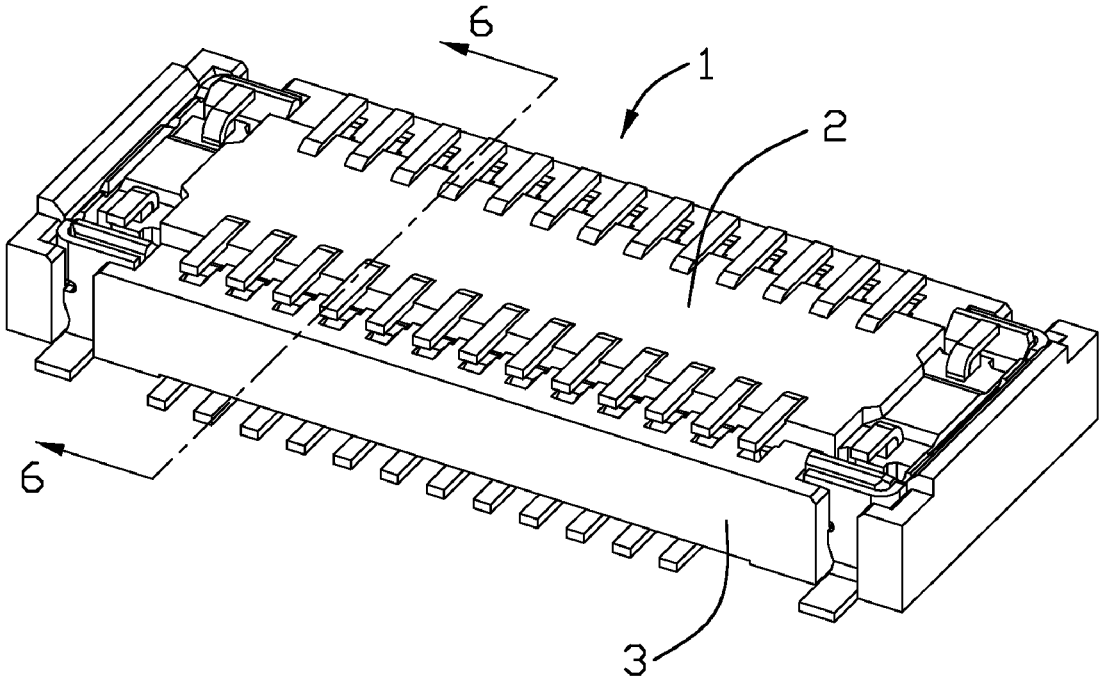
FIG. 1 is a perspective view of an electrical connector in a prefer embodiment of the present invention mating a with counterpart connector.

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

FIGS. 1 to 6 is a preferred embodiment of the present invention. An electrical connector assembly 1 used for connecting with two PCBs includes an electrical connector 2 and a counterpart connector 3 mating with said electrical connector 2. Said electrical connector 2 includes a longitudinal insulating housing 21, a plurality of contacts 22 retained in the insulating housing 21 and two pairs of retention members 23 retained on two longitudinal ends of the insulating housing 21.

In FIGS. 2 to 5, the insulating housing 21 of the electrical connector 2 defines a mating surface mating with the counterpart connector 3 and a receiving room 214 depressed on the mating surface for receiving said counterpart connector 3. The insulating housing 21 includes a pair of sidewalls 211 having a plurality of passageways arranged along the longitudinal direction, a bottom wall 213 and a pair of endwalls 212 connected with said sidewalls 211 and the bottom wall 213 to surround said receiving room 214. Said passageway defines a first portion located on an inner face of the sidewall 211 and a second portion located on an outer face of the sidewall 211 and deeper than said first portion of the passageway. The contact 22 is retained in the passageway and includes a first mating portion 222 on an outer surface of the sidewall 211, a second mating portion 221 retained on an inner surface of the sidewall 211 to commonly define a U-shaped mating portion riding on the sidewall 211 and a soldering portion 223 extending outwards from the second mating portion 221. Said first mating portion 222 is retained in the second portion of the passageway and has a free tip end outwardly offsetting away from the passageway for flexibly engaging with the counterpart connector 3. Said free tip end of the first mating portion 222 offsets from an outer surface of the sidewall 211 and defines a gap 224 located therebetween in order to get an enough flexibility for the first mating portion 222. Said second mating portion 221 is located on an inner surface of the sidewall 211 and retained in the first portion of the passageway to face to the receiving room 214 and engage with the sidewall 211 securely. The second mating portion 221 is also formed as a retaining portion of the contact 22 engaging with the insulating housing 21. A free end of the first mating portion 222 is far away from an inner face of the passageway than other portion of the first mating portion 222.

The first mating portion 222 is not parallel to the corresponding inner face of the passageway. A soldering leg 223 extends outwardly from a bottom end of the second mating portion 222 and passes through the bottom walls 213. The retention member 23 has an approximate same structure with said contact 22 and includes a holding portion 231 and a soldering portion 232 extending from a bottom of the holding portion 231.

The counterpart connector 3 includes a longitudinal insulating body 31, a plurality of terminals 32 retained in the insulating body 31 and a pair of retention members 33 retained on two longitudinal ends of the insulating body 31.

The insulating body 31 includes a pair of sidewalls 311, a pair of endwalls 312 connecting with said sidewalls 311 and a bottom wall 313 to commonly define a receiving groove 34. Said bottom wall 313 defines a longitudinal tongue portion 35 protruding upwardly into the receiving groove 34 and peripherally surrounded by said sidewalls 311 and endwalls 312. Said sidewalls 311 define a plurality of passageways 36 arranged longitudinally to receive said terminals 32. The passageway 36 runs through to the receiving groove 34 on an inner surface of the sidewall 311 and extends inwardly through the bottom wall 313 and tongue portion 35 for retaining said terminal 32.

Figure 2:
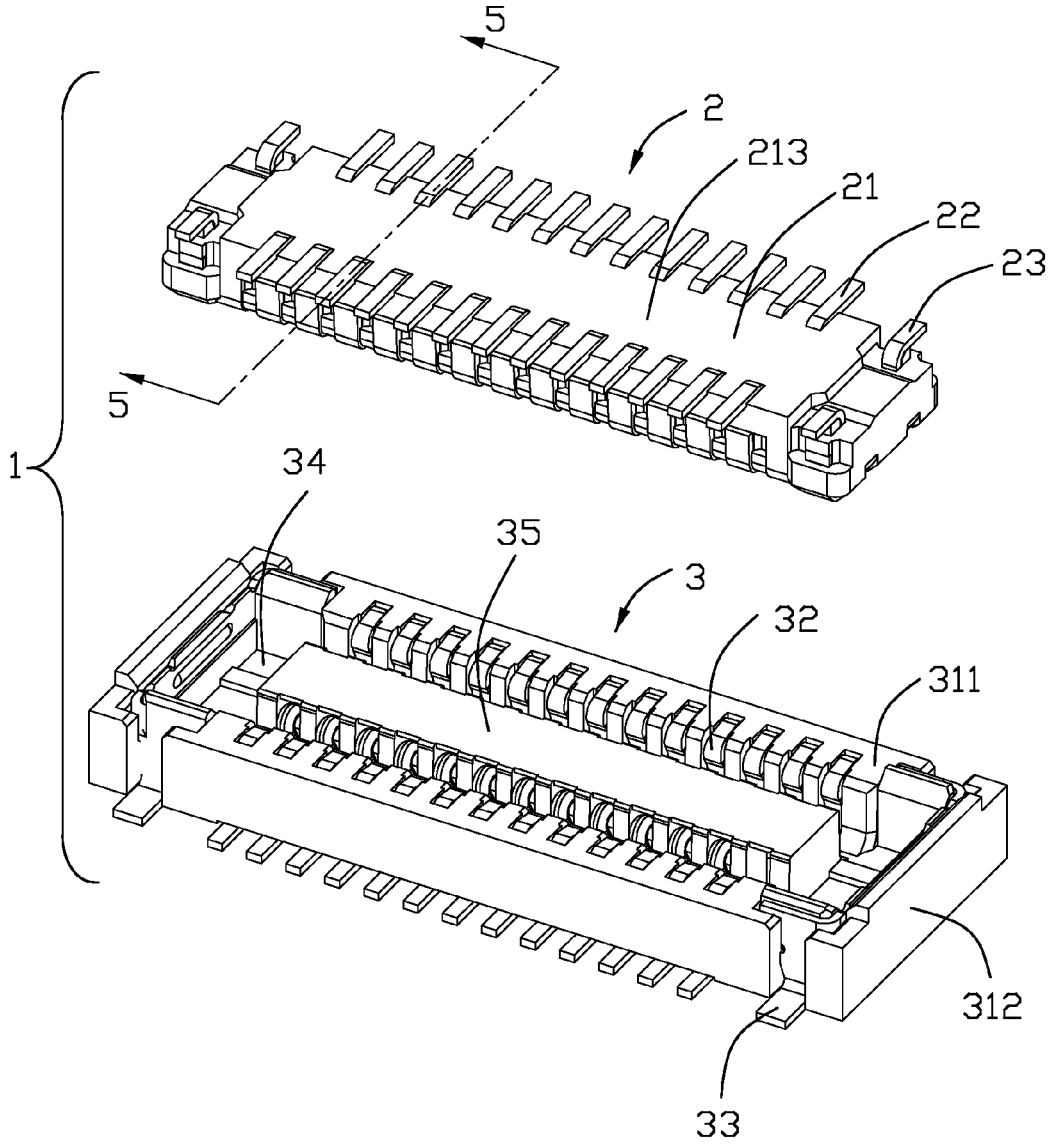
FIG. 2 is a perspective view of the electrical connector and the counterpart connector of FIG. 1.
Figure 3:
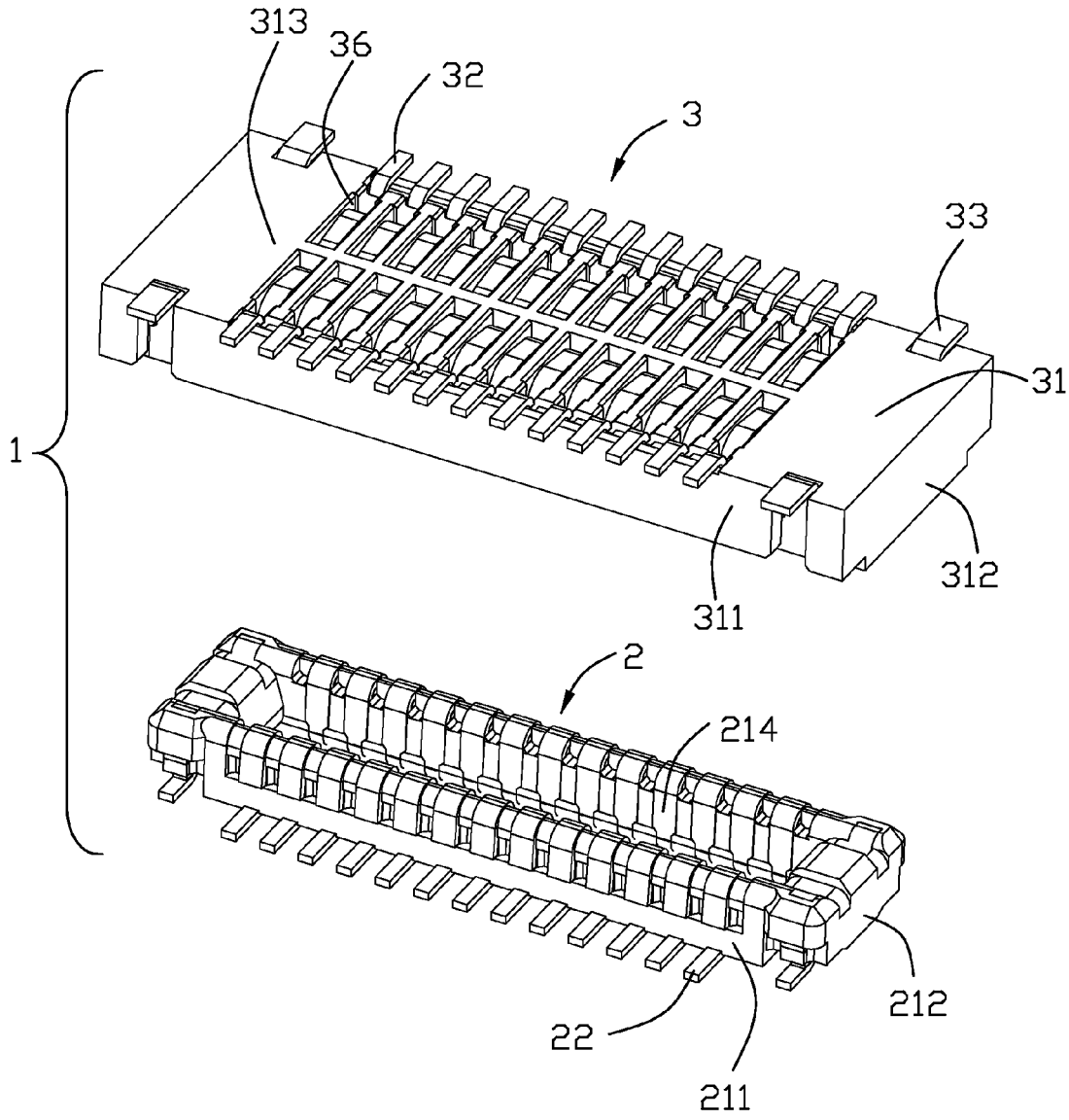
FIG. 3 is another perspective view of the electrical connector and the counterpart connector of FIG. 2.
Figure 4:
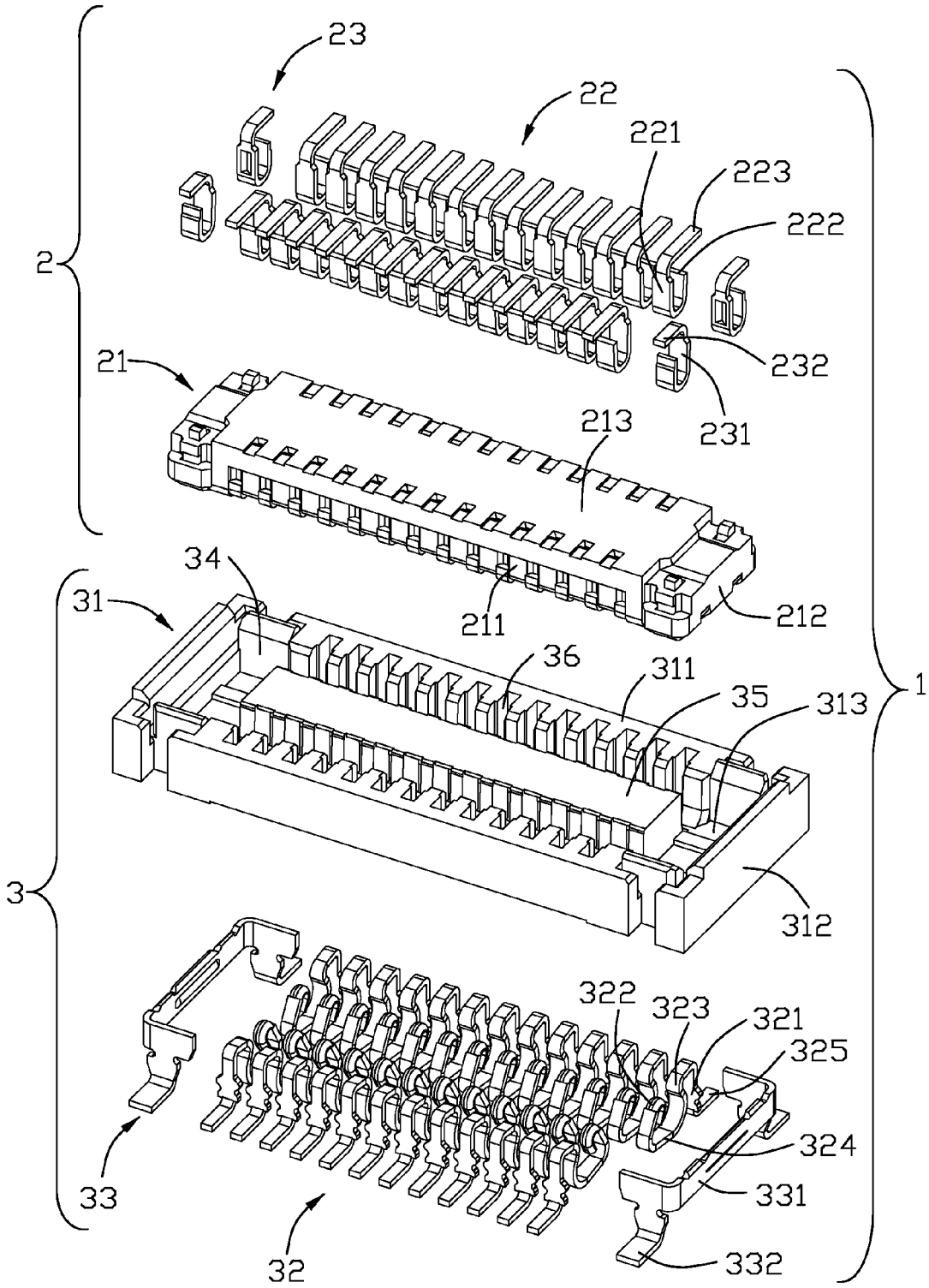
FIG. 4 is an exploded perspective view of the electrical connector and the counterpart connector of FIG. 2.
Figure 5:
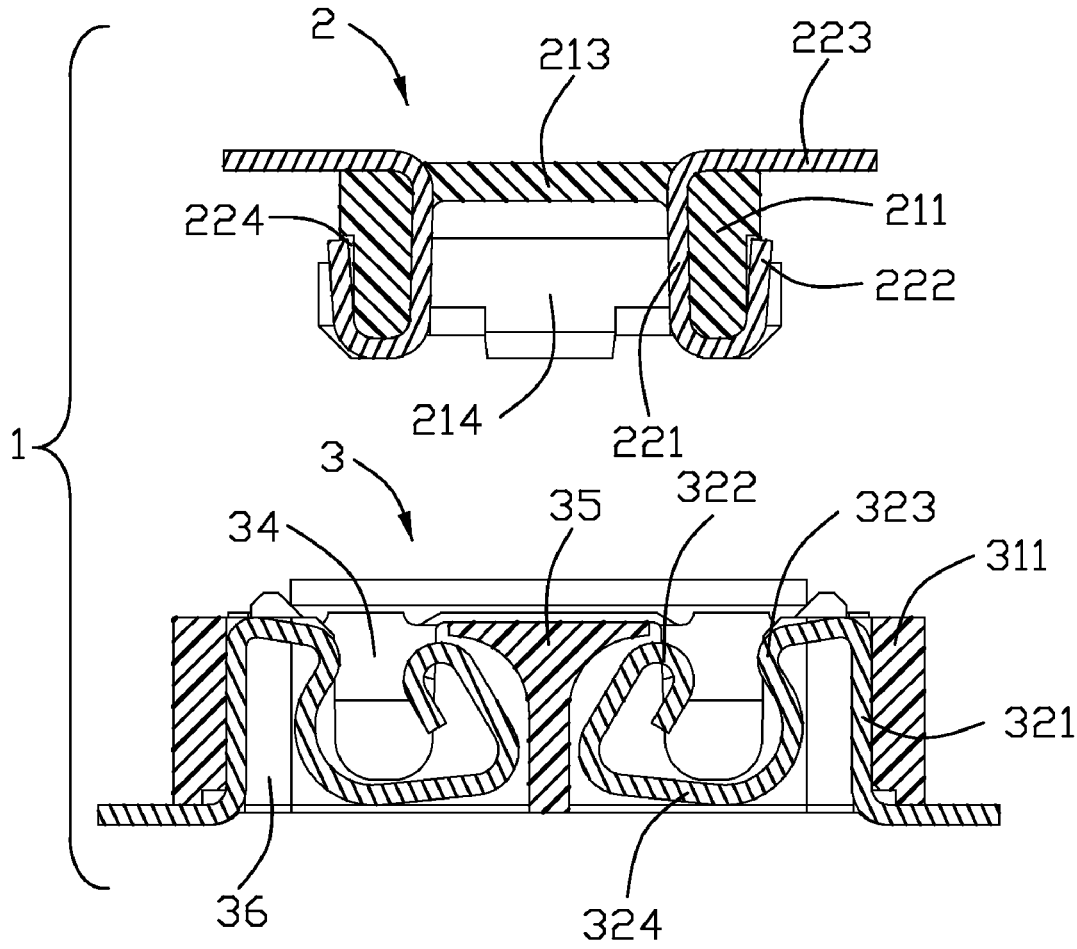
FIG. 5 is a cross-section view of the electrical connector and the counterpart connector of FIG. 2 along line 5-5.

As shown in FIGS. 2 and 3, the terminal 32 includes a vertical retaining beam 321 retained in the sidewall 311, a first contacting beam 323 protruding into the receiving groove 34 from the retaining beam 321, a second contacting beam 322 retained on one side of the tongue portion 35 and a connecting beam 324 connecting with said first contacting beam 323 and second contacting beam 322. The second contacting beam 322 bends back toward said sidewall 311 from an inner end of the connecting beam 324 and extends upwardly and opposite to the first contacting beam 323. As shown in FIG. 4, the retention member 33 defines a base portion 331 retained on the endwall 312 and a pair of soldering pads 332 extending from two ends of said base portion 331.

Figure 6:
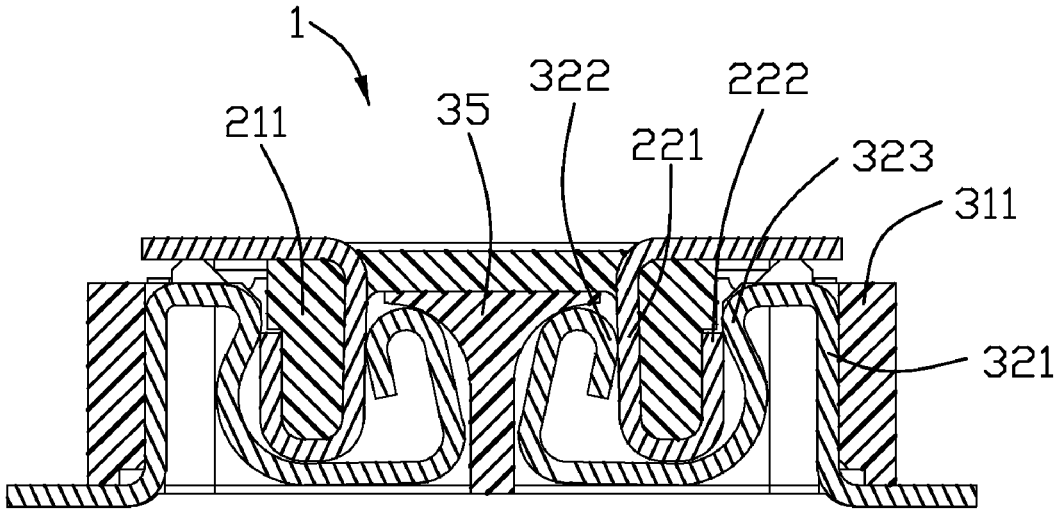
FIG. 6 is a cross-section view of the electrical connector and the counterpart connector of FIG. 2 along line 6-6.

In FIG. 6, the electrical connector 2 mates with the counterpart connector 3 along a mating direction, said contacts 22 of the electrical connector 2 mate with the terminals 32 of the counterpart connector 3. The first mating portion 222 contacts with the first contacting beam 323 while the second mating portion 221 contacts with the second contacting beam 322. Said gap 224 between the first mating portion 222 and the sidewall 211 makes the first mating portion 222 flexible to absorb a dimensional tolerance generated during the mating process. During the mating process, the flexible first mating portion 222 can move inwardly to adjust the mating direction in order to make the mating process smoothly and provide a stable connection between the contact 22 and the terminal 32.

Figure 7:
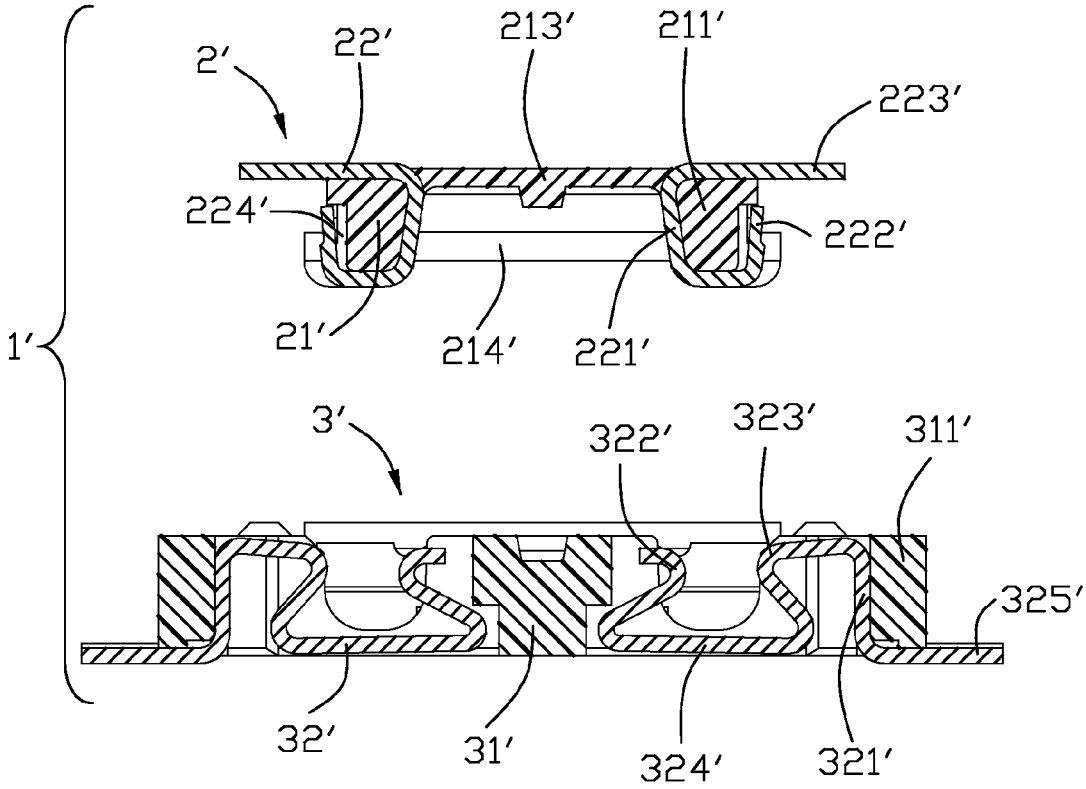
FIG. 7 is a cross-section view of the electrical connector and the counterpart connector in another embodiment.
Figure 8:
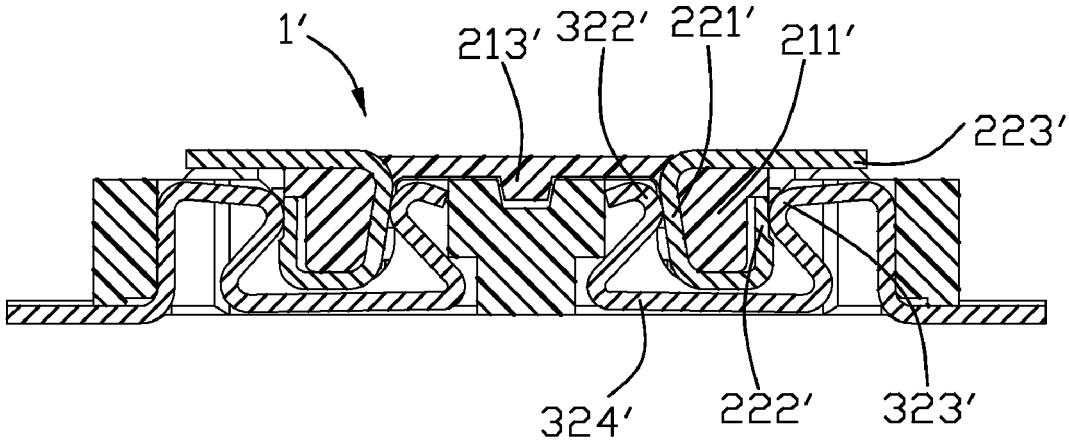
FIG. 8 is a cross-section view of the electrical connector after mating with the counterpart connector of FIG. 7.

In FIG. 7 and FIG. 8, another embodiment of the present invention shows the electrical connector assembly 1' with a low profile including an electrical connector 2' and the counterpart connector 3', which are approximately similar to the electrical connector assembly 1 of the preferred embodiment. The electrical connector 2' is formed in a low profile. The U-shaped structure of the contact 22' rides on the sidewall 211' with a slanted second mating portion 221' and a flexible first mating portion 222'. The slanted second mating portion 221' faces to the receiving room 214' and makes an obtuse angle with the bottom wall 213' in order to smoothly lead the second contacting beam 322' of the terminal 32' of the counterpart connector 3'. The first mating portion 222' of the contact 22' offsets from the sidewall 211' to define a gap 224' therebetween for mating with the first contacting beam 323' of the counterpart connector 3'. In the electrical connector assembly 1', the U-shaped structure of the contact 22' is retained among the first contacting beam 323', the second contacting beam 322' and the horizontal connecting beam 324' of the counterpart connector 3'. The terminal 32' is formed with a low profile to reduce the size of the counterpart connector 3'. The slanted second mating portion 221' and the flexible first mating portion 222' of the electrical connector 2' can provide a smooth mating process. Said gap 224' can absorb a dimensional tolerance generated during the mating process to adjust the mating process smoothly and provide a stable connection between the contacts 22'and the terminals 32'.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising:

an insulating housing having sidewalls and endwalls to commonly define a receiving room;

a plurality of contacts retained in the insulating housing, said contact having a first mating portion retained on an outer surface of the sidewall and a second mating portion retained on an inner surface of the sidewall and facing the receiving room; wherein said first mating portion and said second mating portion define a U-shaped structure riding on the sidewall to sandwich the sidewall therebetween, a gap is defined between said first mating portion and the sidewall.

2. The electrical connector as claimed in claim 1, wherein a free end of the first mating portion can move in said gap.

3. The electrical connector as claimed in claim 1, wherein a free end of the first mating portion shifts outwardly from the sidewall.

4. The electrical connector as claimed in claim 1, wherein the second mating portion extends slantingly extending along the inner surface of the sidewall.

5. The electrical connector as claimed in claim 4, wherein said insulating housing further has a bottom wall connected with said sidewalls and endwalls, said second mating portion of the contact makes an obtuse angle with the bottom wall of the insulating housing.

6. The electrical connector as claimed in claim 5, wherein said electrical connector further includes a pair of retention members retained on two ends of the insulating housing.

7. An electrical connector comprising:

an insulating housing having sidewalls and a plurality of passageways arranged on the sidewall along a first direction;

a plurality of contacts retained and received in the passageways, the contact comprising a retaining portion abutting against an inner face of the passageway in a second direction perpendicular to the sidewalls, a first mating portion located in the passageway while spacing away from the inner face of the passageway in the second direction and a soldering portion extending outward the housing in the second direction, the retaining portion providing a second mating portion thereof, and the first and second mating portions cooperating with each other to sandwich the sidewall therebetween;

wherein the first mating portions abut against the inner faces of the passageways when the electrical connector is mated with a counterpart connector.

8. The electrical connector as claimed in claim 7, wherein any portion of the passageways corresponding to the first contacting portion is deeper than portions of the passageways corresponding to the retaining portion.

9. The electrical connector as claimed in claim 7, wherein the first mating portions are not parallel to the corresponding inner face of the passageways.

10. The electrical connector as claimed in claim 8, wherein free ends of the first mating portions are far away from the inner face of the passageway than other portions of the first mating portion.

11. An electrical connector assembly comprising:

a first connector including a first insulative housing extending along a longitudinal direction and equipped with a plurality of first contacts, each of said first contacts wrapping at least first, second and third sides of a corresponding first side wall of the first housing and including opposite outer and inner mating sections cooperating with each other to sandwich said corresponding first side wall therebetween in a transverse direction perpendicular to said longitudinal direction;

a second connector including a second insulative housing extending along said longitudinal direction and equipped with a plurality of second contacts, each of said second contacts including resilient inner and outer mating portions facing toward each other to sandwich the corresponding first contact via respectively abutting against the corresponding inner and outer mating sections of said corresponding first contact; wherein at least one of said inner mating section and said outer mating section of each of the first contacts, is spaced from the corresponding first side wall with a tiny gap for enhancing resilient engagement between the first contact and the corresponding second contact.

12. The electrical connector assembly as claimed in claim 11, wherein said gap is formed between the outer mating section and the first side wall.

13. The electrical connector assembly as claimed in claim 12 wherein said outer mating section defines a free distal end spaced from the first side wall with said gap therebetween.

14. The electrical connector assembly as claimed in claim 13, wherein said inner mating section also functions as a retention section.

15. The electrical connector assembly as claimed in claim 14, wherein the first contact further includes a horizontal solder sections abutting against a fourth sides of the first side wall.

16. The electrical connector assembly as claimed in claim 11, wherein the other of said inner and outer mating sections of each of said first contacts also functions as retention means.

* * * * *